US005791080A

United States Patent [19]

Hamano

[11] Patent Number: 5,791,080

[45] **Date of Patent: *Aug. 11, 1998**

[54] PRICE INDICATOR MOUNTING UNIT

[75] Inventor: Tsutomu Hamano, Odawara, Japan

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 571,311

[22] Filed: Dec. 12, 1995

[30] Foreign Application Priority Data

Dec. 15, 1994 [JP] Japan ..... 6-312124

[51] Int. Cl.[6] ..... G09F 3/18

[52] U.S. Cl. ..... 40/642.02; 40/661.03; 40/651; 403/362; 403/297

[58] Field of Search ..... 40/642.02, 650, 40/651, 661.03, 662, 745, 757, 759; 403/362, 297, 294; 248/223.41, 224.61, 225.11, 231.21

[56] References Cited

U.S. PATENT DOCUMENTS

| | | | |
|---|---|---|---|
| 2,103,485 | 12/1937 | Meyer . | |
| 2,362,273 | 11/1944 | Hoop | 40/650 |
| 2,827,718 | 3/1958 | Howard . | |
| 3,014,294 | 12/1961 | Singer . | |
| 3,015,177 | 1/1962 | Hembd et al. . | |
| 3,084,463 | 4/1963 | Guyer et al. . | |
| 3,889,408 | 6/1975 | Offner . | |
| 4,556,183 | 12/1985 | Greenberger . | |
| 4,805,331 | 2/1989 | Boggess et al. | 40/651 |
| 4,881,707 | 11/1989 | Garfinkle . | |
| 5,044,104 | 9/1991 | Hopperdietzel . | |
| 5,289,652 | 3/1994 | Kringel et al. . | |
| 5,375,357 | 12/1994 | Butcher et al. . | |

FOREIGN PATENT DOCUMENTS

| | | |
|---|---|---|
| 648368 | 6/1964 | Belgium . |
| 176921 | 10/1961 | Sweden . |
| 2207539 | 2/1989 | United Kingdom . |
| 9307785 | 10/1992 | WIPO . |
| 9319448 | 9/1993 | WIPO . |

*Primary Examiner*—Cassandra H. Davis

[57] ABSTRACT

A price indicator mounting unit which can install a price indicator at any place of a showcase (set of display shelves) and at any kind of display board (display shelf) easily but can not be removed easily by customers. Also, the price indicator mounting unit is inexpensive and capable of getting optional setting angle freely. The price indicator mounting unit comprises one or a plurality of display board mounting members and indicator mounting members, wherein the display board mounting member constituted of a bracket, a stopper plate and a screw, and as the screw is tightened, the both ends of the bracket are opened outward by the stopper plate put between the both ends to engage with a display board. In addition, by replacing the display board mounting member with another one, the connection with a flat rail becomes possible. Further, for the convenience of fitting of the price indicator mounting member and the price indicator, either of them is provided with a flexible protrusion and the other one provided with a convex receptor to receive the protrusion at its end face.

10 Claims, 10 Drawing Sheets

FIG. 3
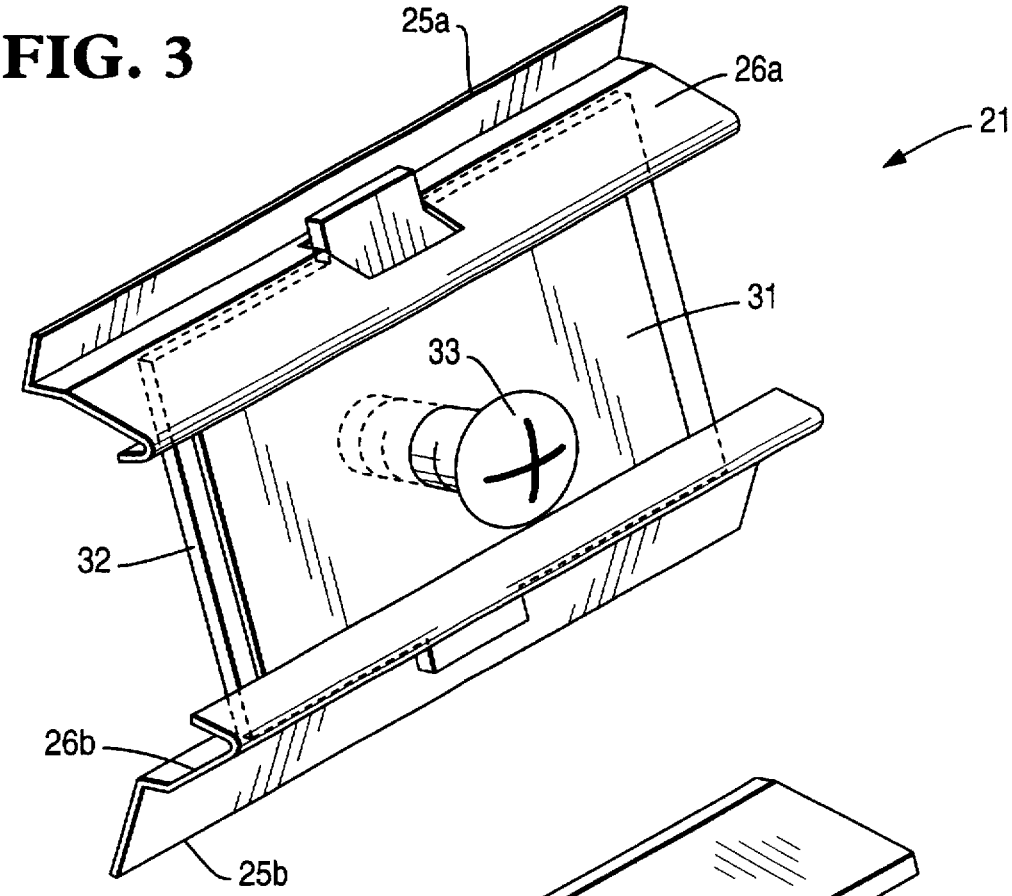
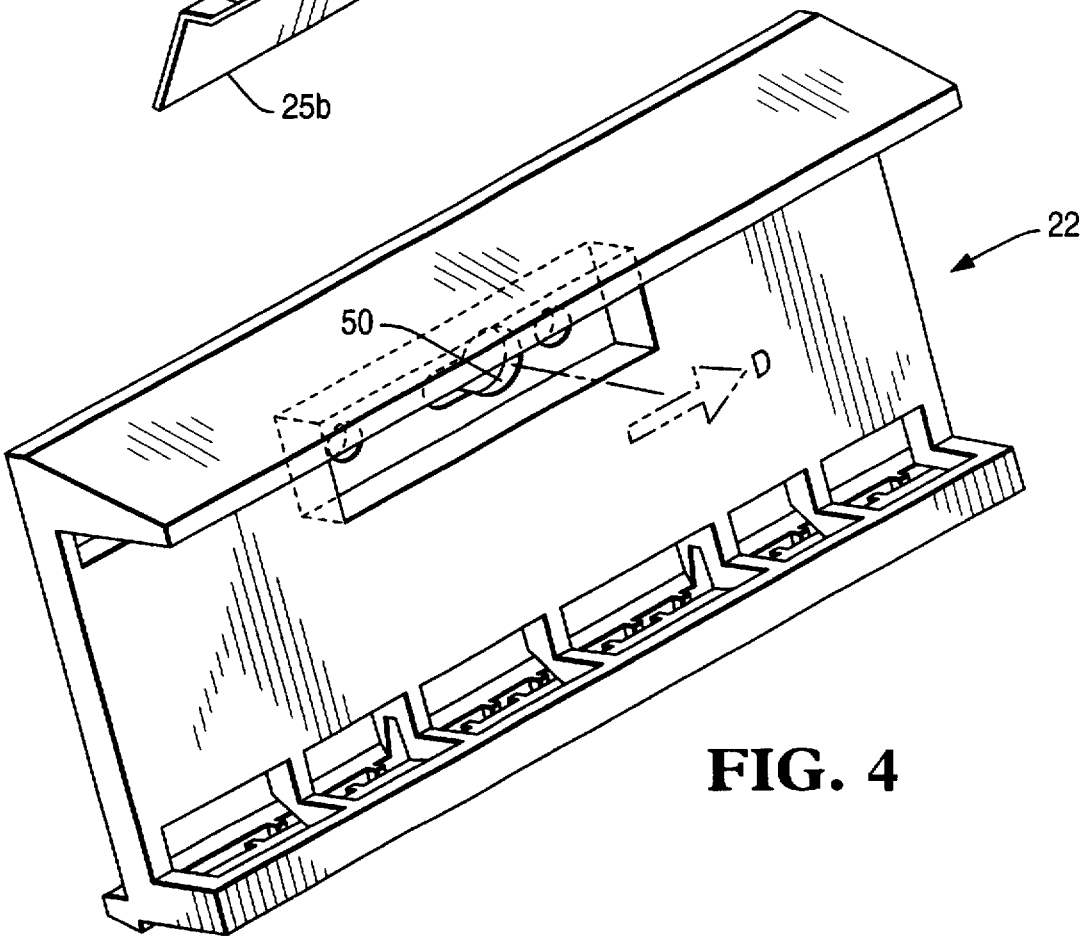
FIG. 4

PRICE INDICATOR MOUNTING UNIT

BACKGROUND OF THE INVENTION

1. Field of the Invention

The present invention relates to a price indicator mounting unit to install price indicators for showcases (display shelves) in a price display system being used in stores such as super markets.

2. Description of the Prior Art

A price display system is the system in which the price indicators are arranged on each showcase by the number of kinds of commodities and made to indicate the price of every individual commodity in each price indicator. The contents of indication (price, etc.) are controlled by a central computer and they can be changed promptly at need.

In such a price display system, since liquid crystal displays are used generally, it is necessary to install the price indicator with an angle that customers can see it easily. A prior art system is constituted so that installing the price indicator including the upper and lower setting legs having different lengths on a showcase by having it turn over at need, and made it able to select two different fitting angles.

SUMMARY OF THE INVENTION

However, among price display systems, there exists a system which performs operations of price indicator and data communications by radio control. In such a radio communication system, there are two requirements that the price indicator has to install at a certain angle to a data transmitter-receiver and the price is indicated so that customer can see it easily. Though the above-stated prior art is capable to select two different angles, in the case of radio communication system, it is required that more fitting angles can be realized easily due to the reasons described above.

Further, since the price indicators are the ones showing the prices of commodities to customers, the price indicated with the price indicator and the position of the commodity must be corresponding with each other. In addition, the number of handling commodities is many in large store, and several ten thousands of price indicators sometimes are installed. Therefore, the installation of the price indicators must be easy. While at the same time, the price indicator has to be made so that it can not be removed easily in order to make it unable to be removed and the position changed by customers freely.

It is an object of the present invention to provide a price indicator mounting unit of which installation is easy in any place of show case, but made it unable to remove by customers.

It is another object of the present invention to provide a price indicator mounting unit which is inexpensive and able to exchange freely in order to get required fitting angles.

The present invention is a price indicator mounting unit for installing price indicators on the display board (display shelf) of a showcase, and it comprises one or more of display board mounting members and indicator mounting members.

The display board mounting member is constituted of a bracket, a stopper plate and a screw, and it is characterized in that as the screw is tightened, both ends of the bracket open outward by the stopper plate put between (or interposed between) both ends of the bracket. Further, in order to make it able to connect the board mounting member with a flat rail, it comprises a bracket for flat rail, a bracket clamp for flat rail and a screw, instead of the above described constitution, and it is characterized in that, as the screw is tightened, the tip of the bracket clamp turns by making the tangent line at which the bracket and the bracket clamp contact with each other as an axis.

The price indicator mounting members are provided with one or more opening portions through which the axis of the screw passes. The object of the present invention has been achieved by constituting it so that at the same time of engaging the display board mounting member and the indicator mounting member, the display board mounting member and the display board of the showcase are engaged.

The object of the present invention which enables setting the price indicator easily but makes it unable to be removed easily has been achieved by providing the price indicator mounting unit characterized in that, for the convenience of fitting together the indicator mounting member and the price indicator, either of them has a flexible protrusion, and the other is provided with a convex receptor for receiving the protrusion at its end face.

The present invention has provided a price indicator mounting unit in which the price indicator is not removable unless a special releasing jig is used by making it characterize the fact that there is a plurality of the flexible protrusions and a protrusion is formed to the price indicator or the indicator mounting member at the position corresponding to each space between the protrusions.

Price indicators generally provide much information, so a slit to hold an advertising paper has provided at the edge part of the indicator mounting member in order to make it able to indicate more detailed information. Further, the present invention has also provided a price indicator mounting unit capable of installing a transparent plate to the entirety or a part of the rear side of the indicator mounting member.

As the screw of the display board mounting member is tightened, the bracket ends holding the stopper plate therebetween are pushed away outward by the stopper plate. The portions which are the front end of a display board and put the end portion of the bracket between them vertically, receive the end portion of the bracket pushed away outward from the both side thereof. By tightening the screw more strong and by the inserted portion of the display board, the bracket edge comes to have a tension strongly, which is then firmly secured to the display board.

In addition, as the screw is tightened for securing it to the flat rail, the tip of bracket clamp for the flat rail turns by making the tangent line at which the bracket for flat rail and the bracket clamp for flat rail contact as an axis. Thereby the end portion of bracket and the end portion of bracket clamp come to hold the flat rail vertically, and the display board mounting member is connected to the flat rail. By bending the tip of the bracket clamp and engaging it with the end of the flat rail, the display board mounting member becomes incapable of being removed easily from the flat rail.

Since the indicator mounting member is provided with an opening through which the screw passes, by tightening the screw, the indicator mounting member and the bracket are clamped by the screw head and the stopper plate and further the end of the bracket is pressed outward, thus it makes also capable the connection with the display board at the same time. Further, if the opening is formed in a state of continuously connecting an opening with a diameter larger than the screw head and an opening having a diameter larger than the screw diameter but smaller than the screw head, by sliding and tightening the screw head at the position of the small opening after passing the screw head of the display board mounting member connected loosely with the display board through the large opening, the connection described above becomes possible.

The flexible protrusion is pressed and bent when the price indicator is fitted in the indicator mounting member, while the flexible protrusion returns to its normal position when the price indicator and the indicator mounting member have been fit. And the end face of the receptor for the convex portion catches the protrusion, thereby the structure easy in installing and difficult in removing can be realized.

By using an indicator mounting member capable installing a plurality of price indicators, the installation of price indicator becomes easier. In addition, by using the indicator mounting member, the front end of display board becomes flat. Thereby the display of commodity and the taking out of commodity become easy.

According to the present invention, the tightening of only one screw enables securing of a price indicator mounting member, a display board mounting member, and a showcase, and price indicator can be installed easily. Therefore, working load can be reduced and the time required for setting price indicator can be remarkably shortened. Further, the tightening by screw becomes capable to carried out the work from in front of a display board, hence the labor of price indicator fitting can be reduced. The present invention brings more effect in case where the price indicator is fitted to a showcase close to the floor.

Further, according to the present invention, by only performing screw adjustment, it becomes capable to correspond to display boards of showcase having various widths different according to each maker, and it becomes unnecessary to prepare price indicators corresponding to the kind of showcase. Further, by only changing a bracket, various fitting angles can be selected, thereby a price indicator mounting unit inexpensive and having adaptability be realized.

The price indicator of the present invention which has been once installed can not be removed easily unless a special releasing jig is used, thus it can protect the theft of price indicator, the exchange and the like.

By providing a price indicator mounting rail as one kind of indicator mounting member in the present invention, a plurality of price indicators are arranged so that they can be kept in the rail, so that there is no chance of indicators coming off or being broken due to an external shock.

Further, the indicator mounting member provided by the present invention is capable of installing an advertising paper and therefore it can offer much more information about commodities for customers.

The present invention provides a price indicator mounting unit which can provide a transparent plate such as plastic cover to the indicator mounting member's surface, thereby the price indicator is protected from dusts, stain at the time of cleaning of floor and the like and it becomes capable to clean the surface easily. Particularly, it is effective to protect the lowermost display board from stained water flying about at the time of floor cleaning.

BRIEF DESCRIPTION OF THE DRAWINGS

FIG. 3 is a perspective view of a display board mounting member.

FIG. 4 is a perspective view of a price indicator mounting member.

DETAILED DESCRIPTION OF THE PREFERRED EMBODIMENTS

Figure 1:
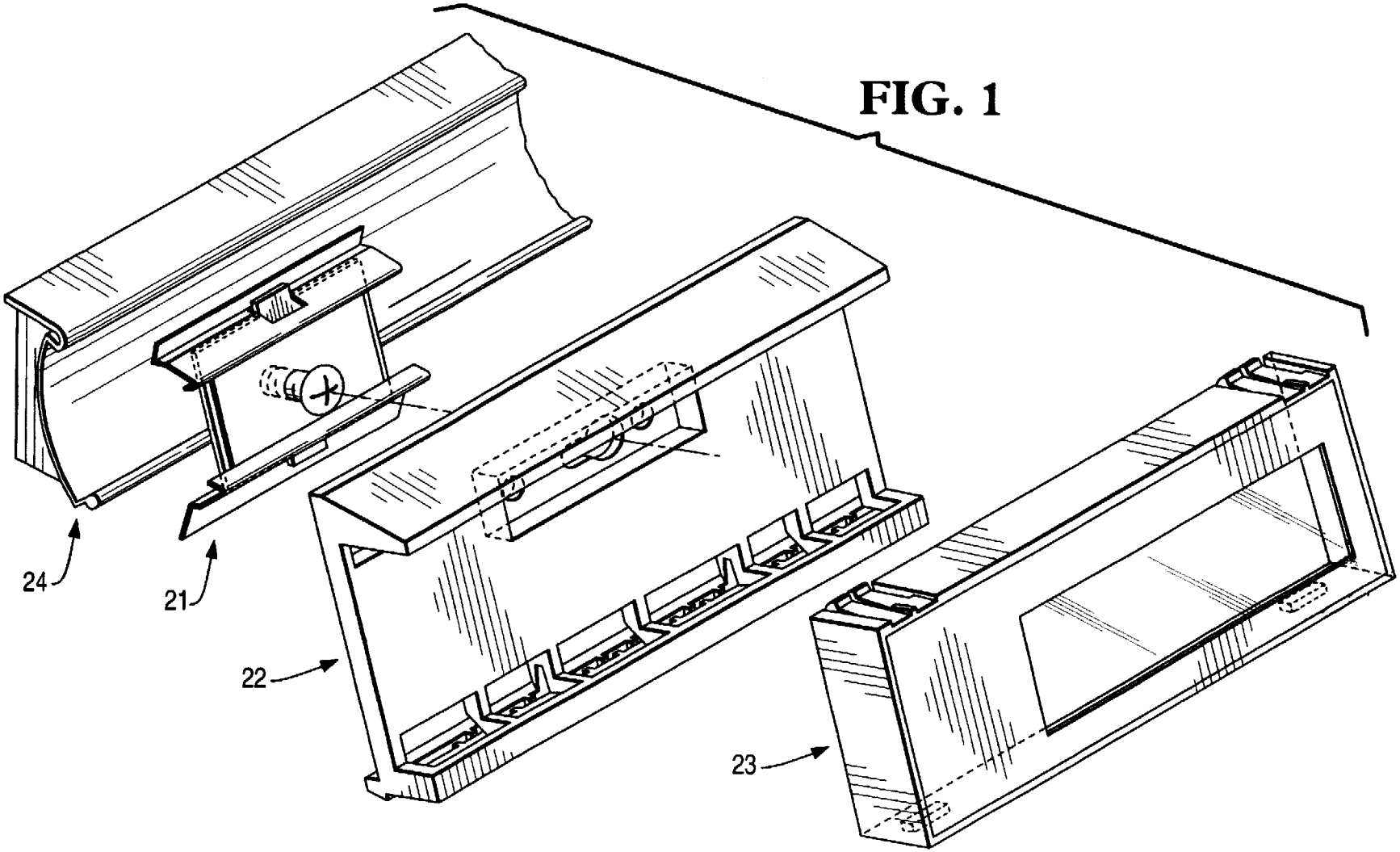
FIG. 1 is a general view of a first preferred embodiment of the present invention.

Referring to the drawings, an embodiment of the present invention is described hereinafter.

An embodiment of the present invention in shown in FIG. 1.

In FIG. 1, 21 represents a display board mounting member, 22 an indicator mounting member, and 23 a price indicator. A front end 24 of a display board is shown enlarged. First, the display board mounting member 21 is connected to the indicator mounting member 22. Then, the display board mounting member 21 and indicator mounting member 22 which have been coupled together, are connected to the front end 24 of the display board. Thereafter, the price indicator 23 is fitted to the indicator mounting member 22, and the price indicator 23 is secured to a showcase.

Figure 2:
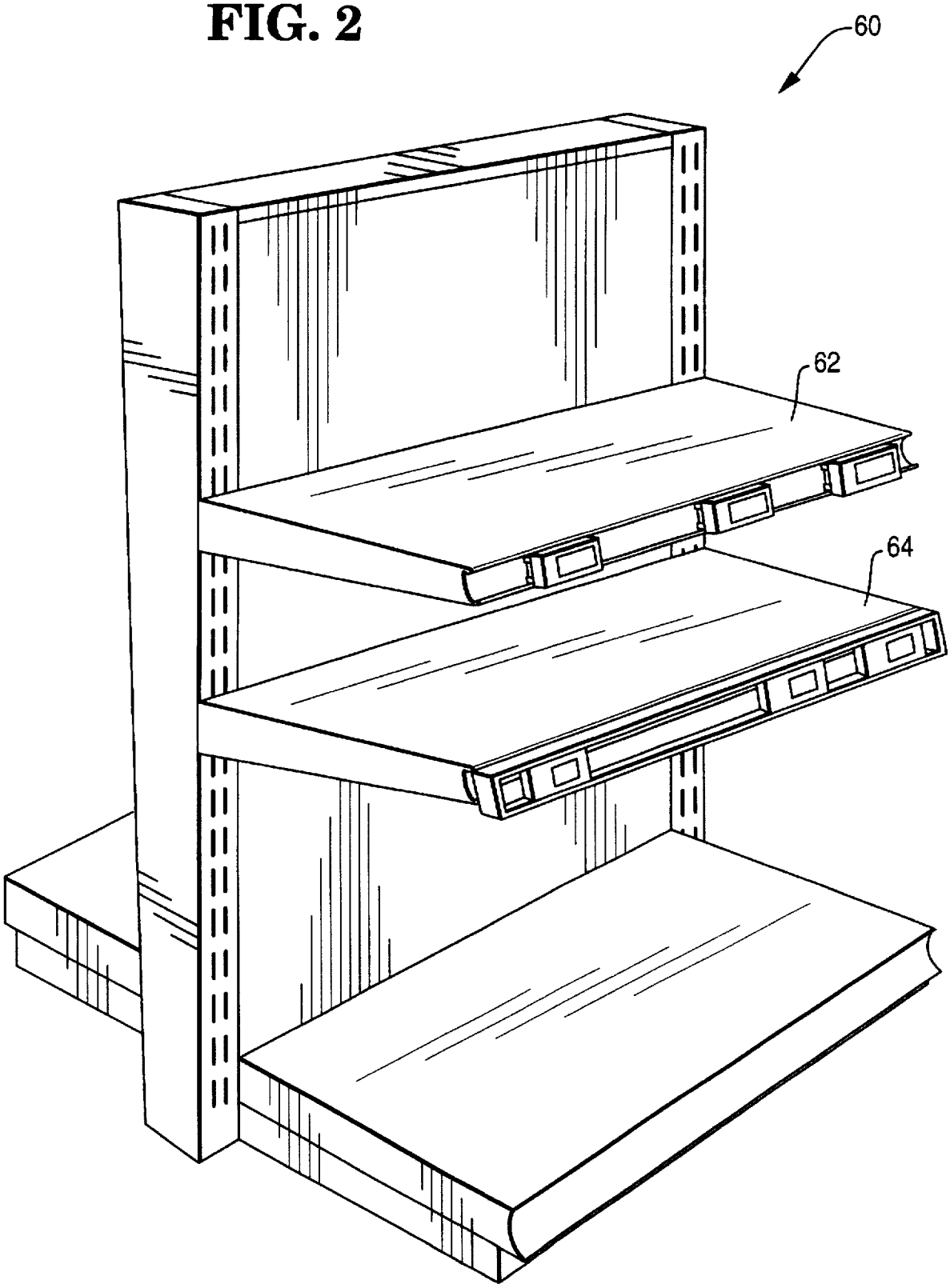
FIG. 2 is a general view showing a state where price indicators are installed to a showcase using the price indicator mounting units of the present invention.

The state in which the price indicator 23 has been fitted to the showcase 60 using the price indicator mounting unit of the present invention is shown in FIG. 2. In this figure, the state in which the price indicators has installed using the mounting unit of the first embodiment according to the present invention to the display board 62 of the showcase 60 is shown, while the state of fitting using the second preferred embodiment which will be described later to the display board 64 of the showcase 60.

FIG. 3 is a perspective view of the display board mounting member 21. The display board mounting member 21 comprises a bracket 31, a stopper plate 32 and a screw 33. Bracket ends 26*a* and 26*b* of the display board mounting member 21 open outward as if they put the stopper plate 32 therebetween from the both sides in the midway thereof. Particularly, the tips 25*a* and 25*b* of the bracket ends 26*a* and 26*b* are being in the shape extended further outside than the bracket ends 26*a* and 26*b*, in order to make the engagement with the front end 24 of the display board easily. The screw 33 passes through the opening provided at the central part of the bracket 31, and it is made connectable by means of a screw hole provided in stopper plate 32.

FIG. 4 is a perspective view of the indicator mounting member 22. The central part of the indicator mounting member 22 is provided with the opening 50 comprising an opening larger than the head diameter of the screw 33 and an opening which adjoining the opening continuously and is smaller than the head diameter of the screw 33 but larger than the screw (shaft) diameter.

Figure 5:
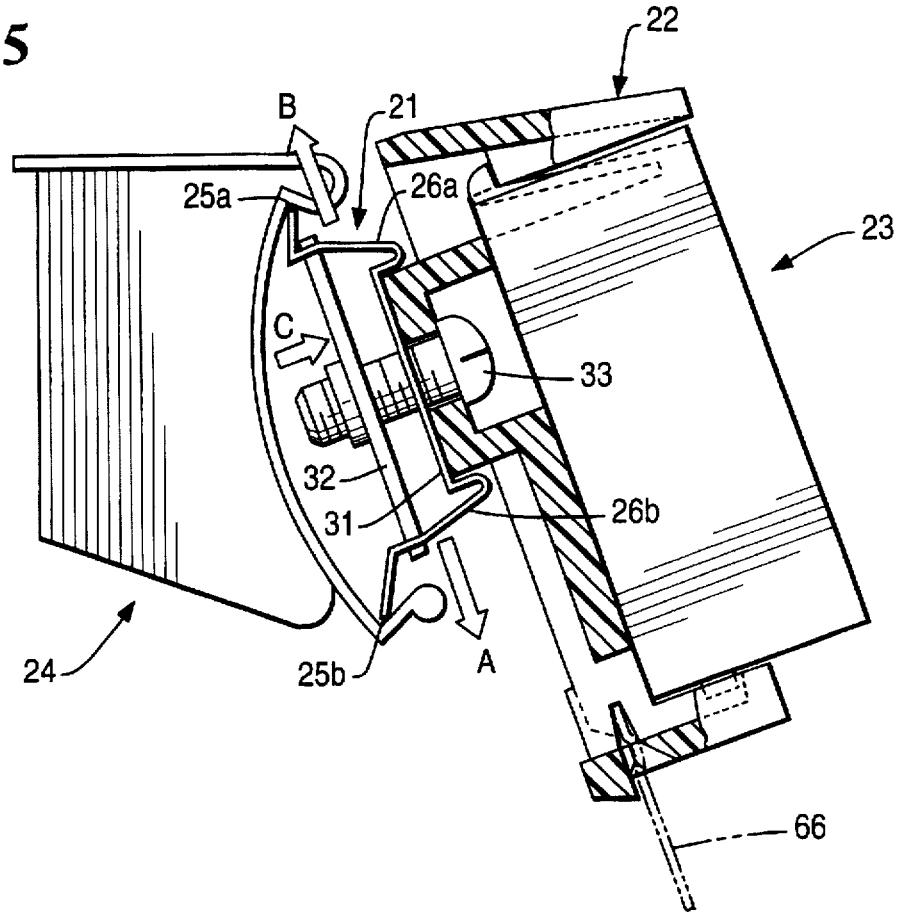
FIG. 5 is a sectional view showing a state where a display board mounting member and an indicator mounting member are connected together, and a state where a display board mounting member and a front end of a showcase are connected together.

FIG. 5 is a sectional drawing viewed from the side and showing the state in which the display board mounting member 21 and indicator mounting member 22 are connected together and the state in which the display board mounting member 21 and the front end 24 of display board are coupled together.

Figure 6:
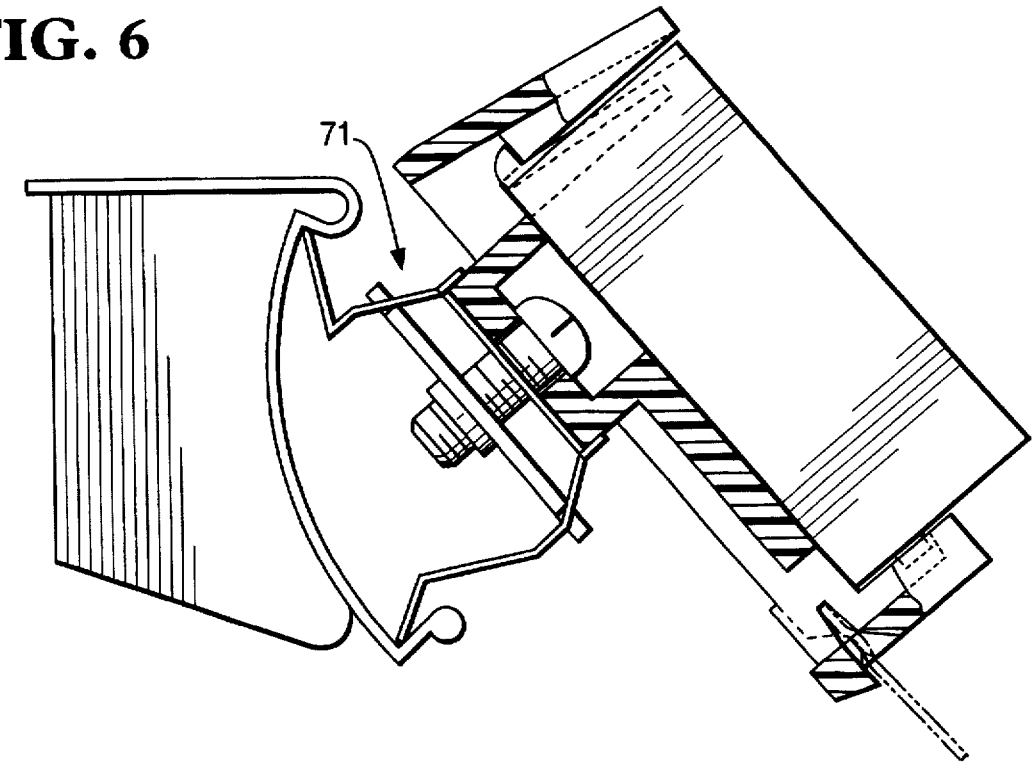
FIG. 6 is a sectional view showing a similar state as FIG. 5 wherein different display board mounting member is used.

FIG. 6 shows the case where another bracket 71 is mounted in place. As is clear from this, by exchanging the bracket to another one having a different shape, optional fitting angles can be obtained. Incidentally, the sectional part is shown basically by oblique line, but since some portion of the drawings become obscured due to showing by oblique line oblique line omitted in some part.

The front end 24 of display board generally has a concave face so that a commodity label can be set at the front end and has a structure so that it holds the commodity label vertically. However, the vertical length of the concave face is different depending on each maker.

Referring to FIGS. 1 and 5, the structure in which the display board mounting member 21, the indicator mounting member 22 and the front end 24 of the display board are connected together is described hereinafter.

First, in order to connect the display board mounting member 21 with the indicator mounting member 22, the head of the screw 33 is passed through the larger opening between the opening 50 as keeping the state in which though the screw is set in the display board mounting member 21 but it is not fastened, and the display board mounting member 21 and indicator mounting member 22 are brought into contact with each other. Then, after shifting the indicator mounting member to the direction of arrow D so that the screw positions at the position of smaller opening between the openings 23 of the indicator mounting member 22, the screw is fastened (or tightened).

Subsequently, the display board mounting member 21 and indicator mounting member 22 which have been coupled together are connected to the front end 24 of display board according to the following procedures. Namely, bracket tips **25*a* and 25*b* of the display board mounting member 21 are engaged at the portion where the front end 24 of display board is between them vertically. Further, as shown in FIG. 5, the screw 33 is fastened (or tightened). Depending on this fastening (or tightening), the stopper plate 32 shifts to the right side as shown by the arrow C, it performs the work of pressing away the bracket ends 26*a* and 26*b* outward. Thereby, the bracket tips 25*a* and 25*b* are opened outward (in the directions of arrows A and B shown in FIG. 5), but they are firmly caught by the front end 24 of the display board, the tension of the bracket ends 26*a* and 26*b*** increases and the price indicator is secured to the display board.

From the foregoing, it will be understood that the screw 33 makes both the connection between the display board mounting member 21 and indicator mounting member 22 and the connection between the display board mounting member 21 and front end 24 of the display board capable by performing the fastening (or tightening) only once (or in one step). Incidentally, if the bracket tips have a shape able to engage them with the front end 24 of display board, it is unnecessary to make it to the state shown above embodiment in which the tips further open outward.

Figure 7:
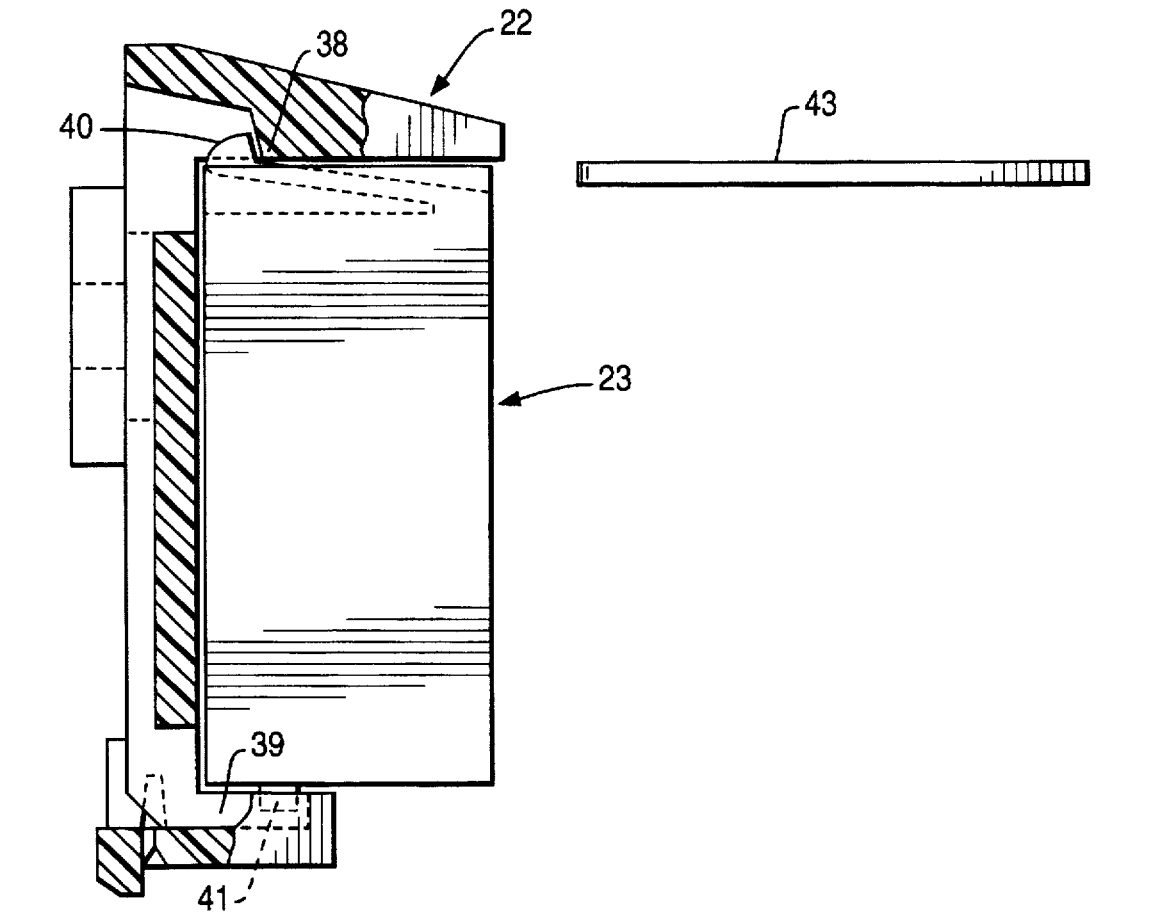
FIG. 7 is a sectional view showing a state wherein a price indicator and an indicator mounting member are engaged with each other and shows a releasing plate for releasing the engagement.
Figure 8:
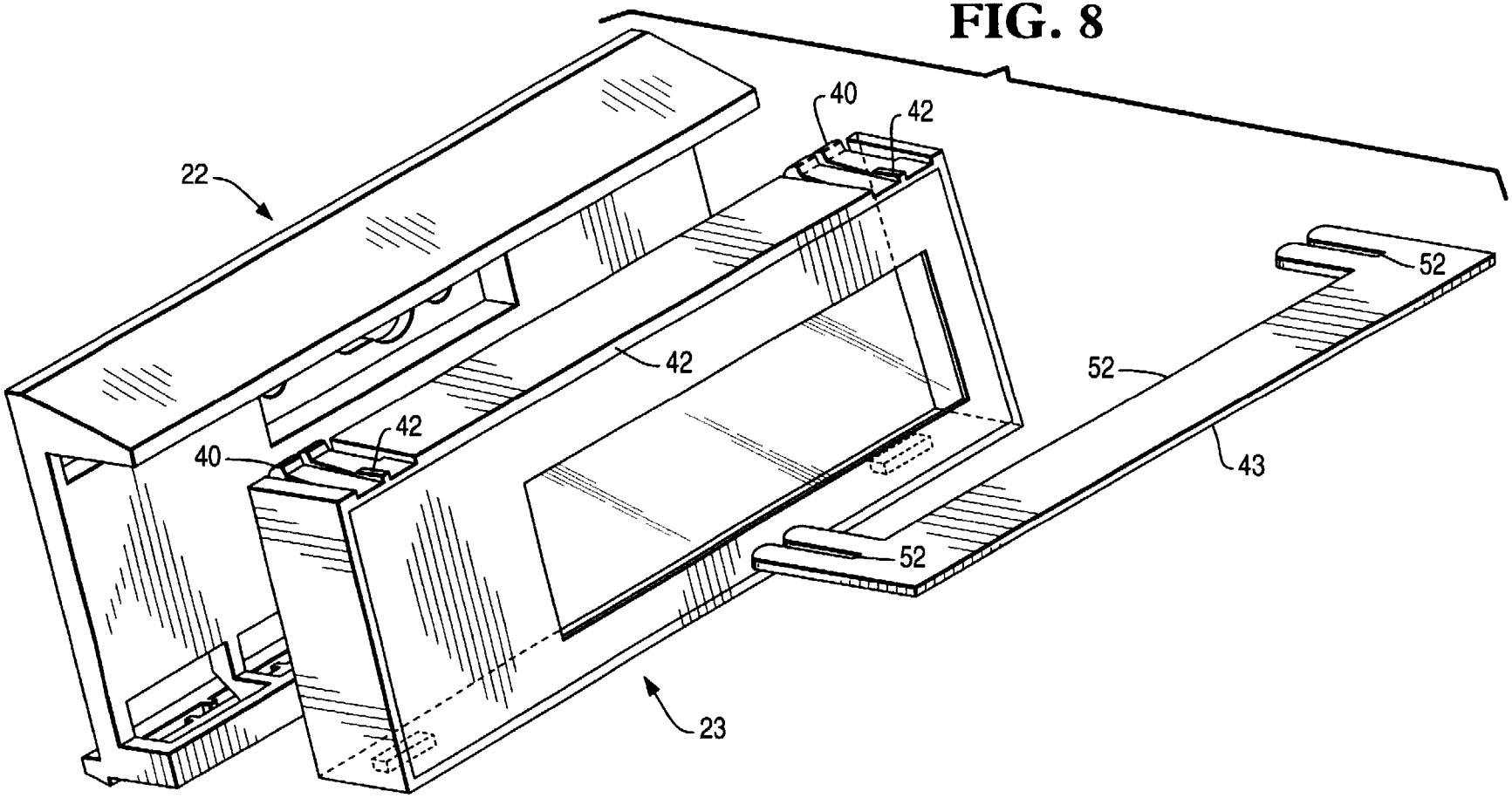
FIG. 8 is a perspective view showing a price indicator having two pair of protrusions (key-shaped stoppers) on the left and right, an indicator mounting member, and a releasing plate.

FIGS. 7 and 8 are a sectional view and a perspective view, respectively, showing the state in which the price indicator 23 and indicator mounting member 22 engage with each other and the releasing plate 43 for releasing their engagement. Indicator mounting member 22 is provided with a convex portion 38 and concave portion 39, respectively, at the upper and lower ends thereof. While, a flexible protrusion 40 made so that it engages with the end face of the convex portion (illustrated as a key-shaped stopper) is formed at the upper end of the price indicator 23. On the other hand, the convex portion 41 capable of engaging with concave portion 39 is formed at the lower end of the price indicator 23.

The procedure of fitting the indicator mounting member 22 and price indicator 23 is such that, first engaging convex portion 41 and concave portion 39, turning the price indicator 23 around the engaged point to fit it within the indicator mounting member. At this time, the flexible protrusion (key-shaped stopper) 40 is pressed and bent downward by the head part of convex portion 38 of the indicator mounting member, but when they are fitted completely, the flexible protrusion 40 returns to the normal position due to elastic recovery force, since the connection is fixed owing to receive the protrusion (key-shaped stopper) 40 by the end face of the convex portion 38, the price indicator can not remove from the indicator mounting member 22 easily.

The engage portions described above may be provided not only one to top and bottom but plural. By doing so, the reliability of engagement would be improved. In addition, in FIG. 7, the protrusion (key-shaped stopper) is provided on the price indicator 23 while the convex portion 38 engaging with the protrusion (key-shaped stopper) 40 is provided on the indicator mounting member 22. But it is clear that the fitting is feasible, even though the protrusion (key-shaped stopper) 40 is formed on the indicator mounting member 22 and the convex portion 38 is formed on the price indicator, if the relation of engagement illustrated in the procedure of fitting is maintained. Further, though the protrusion 40 has a key shape in this case, any shape will do if the relation of engagement described above is maintained.

In order to release the connection between the indicator mounting member 22 and the price indicator 23, it is realized by inserting the releasing plate 43 from a gap of the upper engagement portion, pressing down the flexible protrusion (key-shaped stopper) 40 and releasing the protrusion from the engagement with the end face of the convex portion 38.

FIG. 8 is a perspective view showing the price indicator 23 having two pairs of protrusion (key-shaped stopper) in the right and left, the indicator mounting member 22 and the releasing plate 43. Since insertion preventive convex portions 42 are provided between the protrusions (key-shaped stopper) 40 of price indicator 23, unless the releasing plate 43 having notches corresponding to the portions, any plate can not insert into the engagement portion so that the connection between the indicator mounting member 22 and price indicator 23 can not release. Further, even if inserting a plate into only one side of pairs of protrusion and releasing one engagement portion, another engagement portion remains as it is, thereby the price indicator 23 cannot be released from the indicator mounting member 22. In addition, since the screw 33 which connects the display board mounting member 21 and the front end 24 of the display board as well as connects the display board mounting member 21 and the indicator mounting member 22 is concealed behind the price indicator 23, it is impossible to release the connection easily.

Incidentally, it can be conjectured that the above-mentioned effect would be maintained even though the insertion preventive convex portions 42 are formed on the indicator mounting member 22, if it is positioned between the protrusions (key-shaped stoppers) 40.

Thus, the present invention can provide a price indicator mounting unit which can correspond to showcases having various types and a price indicator can connect with a showcase easily, no matter where the showcase is located, but which is unable to be removed easily by shopping customers.

Incidentally, a plural number of the protrusion (key-shaped stopper) 40 and insertion preventive convex portion 42 may be provided. If it is done, the reliability of connection could be improved.

Next, with reference to FIG. 9, the second embodiment of the present invention is described hereinafter.

Figure 9:
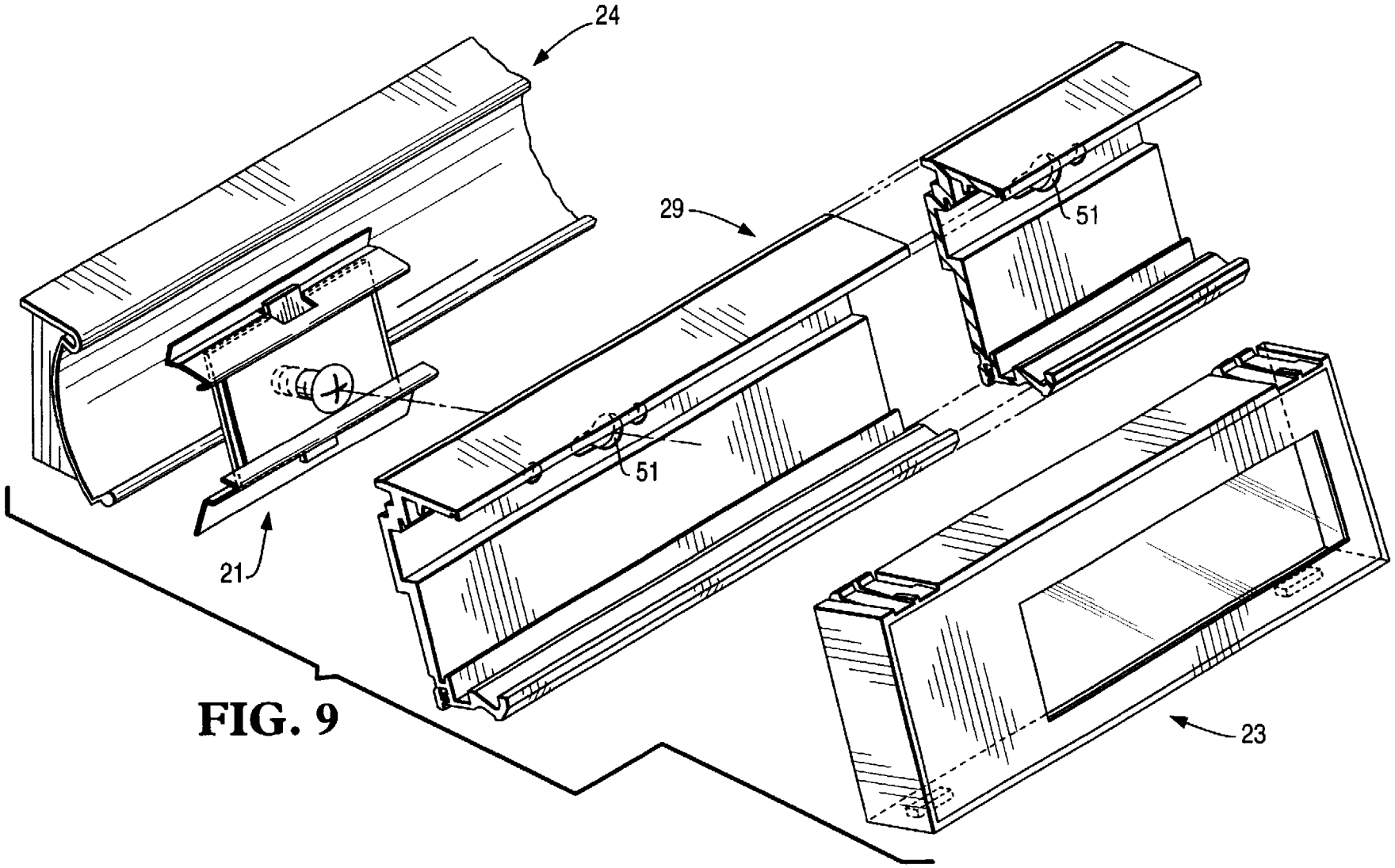
FIG. 9 is a general view of a second preferred embodiment using an indicator mounting rail of the present invention.

As is understood from a comparison between FIGS. 1 and 9, the second embodiment is approximately similar to the first embodiment with respect to the constitution. The point differ from the first embodiment, is that an indicator mounting rail 29 is provided instead the indicator mounting member 22.

The external appearance of the display board used for the mounting unit of the second embodiment is shown in FIG. 2 (on display shelf 64). As is clear from this figure, the indicator mounting member 22 is an attachment for installation (hereinafter called the indicator mounting member 22 as the indicator mounting rail 29 in order to make clear the distinction between the first embodiment and the second embodiment; however, they are different in appellation only and the indicator mounting rail is included in the indicator mounting member 22) which can install a plurality of price indicators.

Referring to FIG. 9, the indicator mounting rail 29 has a structure approximately same as the indicator mounting member 22. The different points between them are that the indicator mounting rail 29 is laterally longer than the indicator mounting member 22 thereby a plurality of price indicators can be set to one indicator mounting rail 29, and that, in order to firmly secure an indicator mounting rail 29 to a display board, the indicator mounting rail 29 is provided with a plurality of opening portions 51 for screw comprising an opening larger than the head diameter of the screw 33 and an opening adjoining above one and smaller than the head diameter of the screw 33 but larger than the screw diameter.

Figure 10:
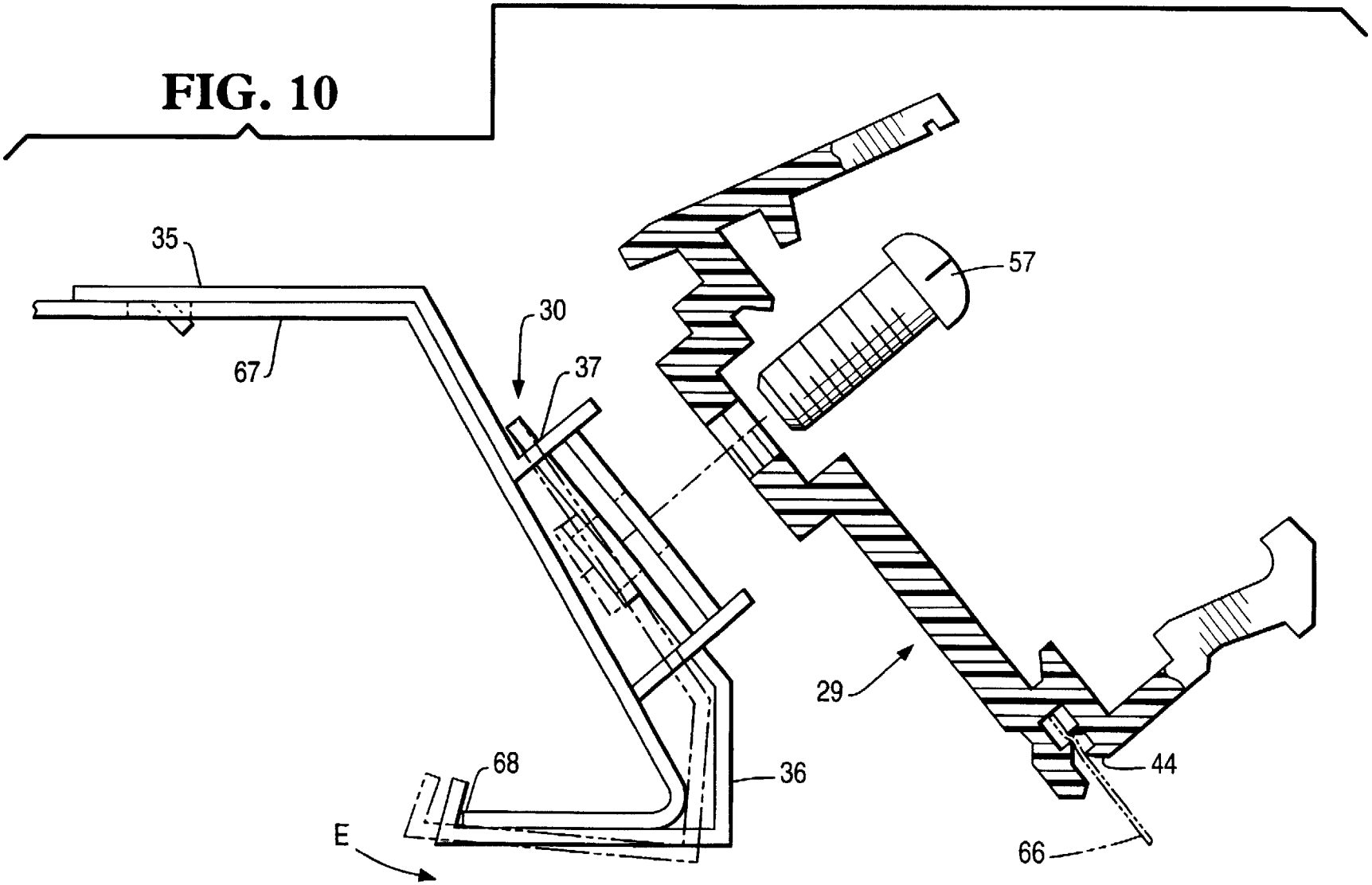
FIG. 10 is a sectional view showing an engagement between a display board mounting member a flat rail, and an indicator mounting member.

FIG. 10 shows an embodiment concerning the setting of the price indicator 23 in the case where the end face of showcase is flat (hereinafter referred to as flat rail 67). The different portion from FIG. 9 is only the constitution of display board mounting member. The display board mounting member 30 for the flat rail comprises a bracket for flat rail 35, a bracket clamp for flat rail 36 and a screw 57. The constitution of the display board mounting member for flat rail 30 which engages with the flat rail is described hereinbelow. Since the fitting of the indicator mounting rail is similar to that of the indicator mounting member of the first embodiment 1, it is omitted here. Passing the screw 57 through the opening provided on the bracket for flat rail 35, and it is fastened into a screw hole of the bracket clamp for flat rail 36. As the screw 57 is fastened (or tightened), the tip of the bracket clamp for flat rail 36 turns in the direction of arrow E by making the tangent line 37 at which the bracket for flat rail 35 and the bracket clamp for flat rail 36 contact as an axis, thereby the flat rail is put between the bracket for flat rail 35 and the bracket clamp for flat rail 36 and secured. Further, taking into account the fact that the bracket clamp 36 turns and is pulled toward the screw head at the same time when the screw 57 is fastened (or tightened), and by providing a protrusion able to engage with the end 68 of flat rail 67 to the bracket clamp for flat rail 36 or making the tip there of into check mark shape for example, the protrusion or the tip of check mark shape engages with the end portion 68 of the flat rail 67, and the display board mounting member 30 is secured to the flat rail 67, thereby it can be made into the state unable to remove the price indicator easily.

Some flat rail 67 has a plurality of holes in an upper plate on which commodities are arranged. Therefore, by providing protrusions being engaged with the holes to the bracket for flat rail 35 or bending the tip portions thereof into check mark shape, the holes and the protrusions or the tip portions of check mark shape engage with each other, thereby the display board mounting member 30 secured to the flat rail 67.

It would be clear that the connection of the display board mounting member for flat rail 30 with the indicator mounting member 22 is also possible.

Figure 11:
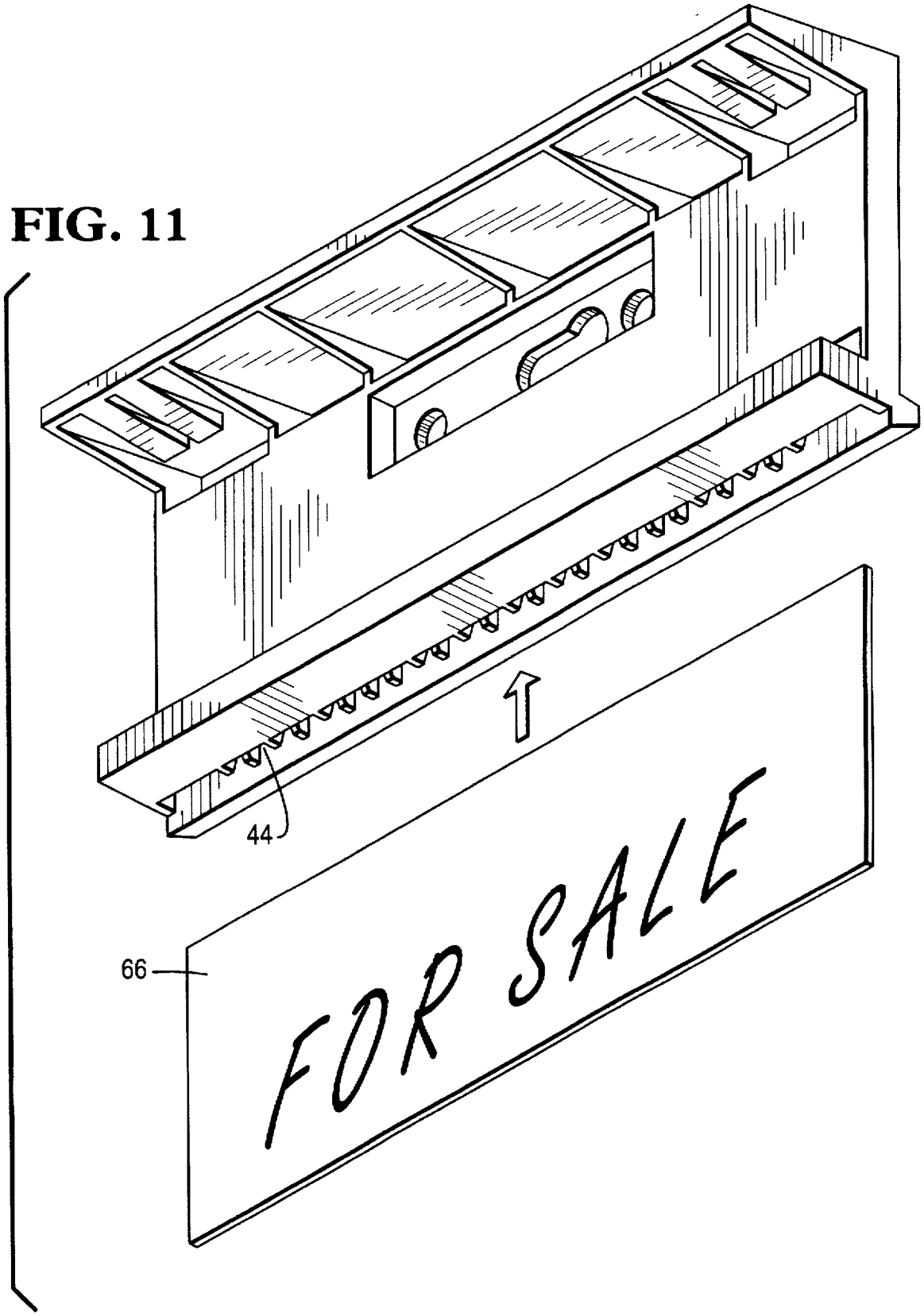
FIG. 11 shows notch-like slit provided at the lower edge of an indicator mounting member or an indicator mounting rail, and a POP (or advertising) paper.

A notch-like slit 44 is provided at the lower edge of the indicator mounting member 22 or indicator mounting rail 29 as shown in FIG. 11, and the slit is made so that an advertising paper (hereinafter referred to as POP paper 66) for advertisement or for representing information concerning commodities is inserted. The POP paper is secured in the state where it is put between edges of the slit 44. Thereby detailed information about the commodity shown by the price indicator 23 can be presented.

Figure 12:
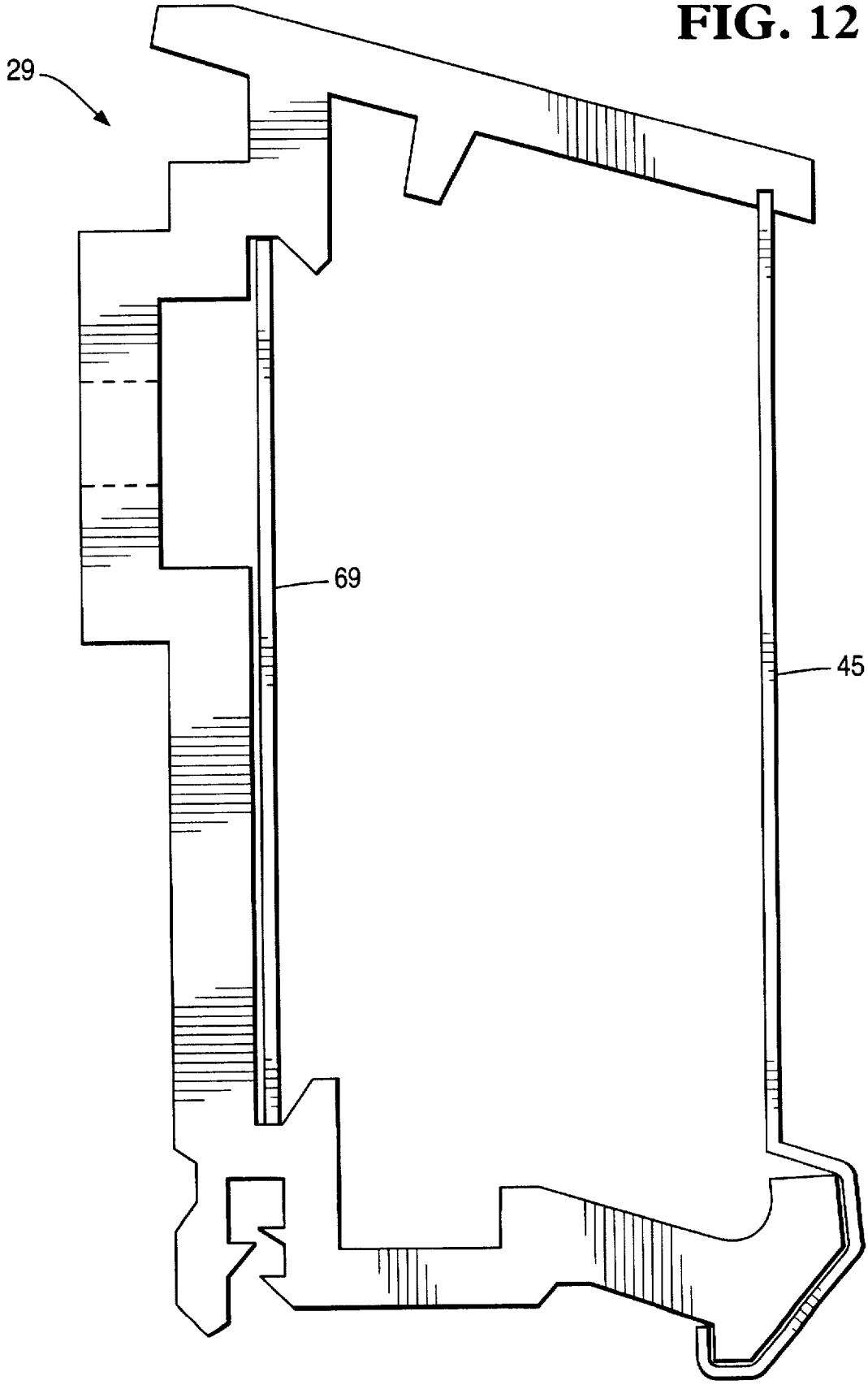
FIG. 12 is a sectional view of a transparent plate arranged in front of an indicator mounting rail.

In FIG. 12, the one provided with a transparent plate 45 made of transparent plastic and the like to the whole surface or a part of the indicator mounting member 22 or indicator mounting rail 29 set a price indicator therein is shown by making a indicator mounting rail as an example. In the case where there is not frequent price change, instead of installing the price indicator 23, a commodity label 69 (FIG. 12) representing price, information and the like may be provided on the indicator mounting member 22 or the indicator mounting rail 29.

What is claimed is:

1. An apparatus for mounting at least one price indicator on a display shelf having a front end and having a concave face at the front end of the shelf, comprising:

a display shelf mounting member, wherein said display shelf mounting member includes a bracket having a first end and a second end, a stopper plate interposed between the first end and the second end of the bracket, and a screw having a head and passing through the bracket and the stopper plate, wherein the tightening of the screw pulls the stopper plate toward the bracket causing the bracket ends to push outward, fitting into ends of the concave face of the shelf; and an indicator mounting member having at least one aperture through which the screw passes, wherein the head of the screw secures the indicator mounting member to the display shelf mounting member and wherein at least one price indicator is installed into the indicator mounting member;

wherein the indicator mounting member further includes at least one convex member for fitting with at least one flexible protrusion on the price indicator for securing the price indicator.

2. An apparatus for mounting at least one price indicator on a display shelf having a front end and having a concave face at the front end of the shelf, wherein an information on a face of the price indicator is observable when a customer is facing the display shelf, comprising:

a display shelf mounting member, wherein said display shelf mounting member includes a bracket having a first end and a second end, a stopper plate interposed between the first end and the second end of the bracket, and a screw having a head and passing through the bracket and the stopper plate, wherein the tightening of the screw pulls the stopper plate toward the bracket causing the bracket ends to push outward, fitting into ends of the concave face of the shelf; and an indicator mounting member having at least one aperture through which the screw passes, wherein the head of the screw secures the indicator mounting member to the display shelf mounting member and wherein at least one price indicator is installed into the indicator mounting member;

wherein the ends of the bracket are shaped to determine a mounting angle of the face of the price indicator with respect to the face of the display shelf and wherein the first end of the bracket has a shaped substantially different from the second end.

3. The apparatus of claim 2 wherein the aperture in the indicator member comprises an aperture portion larger than the head of the screw adjoining an aperture portion smaller than the head of the screw and larger than the shaft of the screw.

4. The apparatus of claim 2 wherein the indicator mounting member further includes a slit to insert a paper into.

5. An apparatus for mounting at least one price indicator on a display shelf having a front end, comprising:

a display shelf mounting member, wherein said display shelf mounting member includes a bracket having a first end and a second end, a stopper plate interposed between the first end and the second end of the bracket, and a screw having a head and passing through the bracket and the stopper plate, wherein the tightening of the screw pulls the stopper plate toward the bracket causing the bracket ends to push outward, fitting into upper and lower lips on the front end of the display shelf; and an indicator mounting member having at least one aperture through which the screw passes, wherein the head of the screw secures the indicator mounting member to the display shelf mounting member and wherein at least one price indicator is installed into the indicator mounting member;

wherein the indicator mounting member further includes at least one convex member for fitting with at least one flexible protrusion on the price indicator for securing the price indicator.

6. An apparatus for mounting at least one price indicator on a display shelf having a front end, wherein an information on a face of the price indicator is observable when a customer is facing the display shelf, comprising:

a display shelf mounting member, wherein said display shelf mounting member includes a bracket having a first end and a second end, a stopper plate interposed between the first end and the second end of the bracket, and a screw having a head and passing through the bracket and the stopper plate, wherein the tightening of the screw pulls the stopper plate toward the bracket causing the bracket ends to push outward, fitting into upper and lower lips on the front end of the display shelf; and an indicator mounting member having at least one aperture through which the screw passes, wherein the head of the screw secures the indicator mounting member to the display shelf mounting member and wherein at least one price indicator is installed into the indicator mounting member;

wherein the ends of the bracket are shaped to determine a mounting angle of the face of the price indicator with respect to the front end of the display shelf and wherein the first end of the bracket has a shaped substantially different from the second end.

7. The apparatus of claim wherein the aperture in the indicator member comprises an aperture portion larger than the head of the screw adjoining an aperture portion smaller than the head of the screw and larger than the shaft of the screw.

8. The apparatus of claim 6 wherein the indicator mounting member further includes a slit to insert a paper into.

9. A method of mounting a price indicator on a display shelf having a front end, wherein an information displayed on a face of the price indicator is observable when a customer is facing the display shelf, comprising the steps of:

selecting a display shelf mounting member having a bracket having two ends, a stopper plate, and a screw having a head, wherein the ends of the bracket are shaped to determine the mounting angle of the face of the price indicator with respect to the front end of the display shelf and wherein the first end of the bracket has a shaped substantially different from the second end;

placing an indicator mounting member having an aperture next to the display shelf mounting member wherein the head of the screw passes through a portion of the aperture which is larger than the screw head;

shifting the indicator mounting member so the screw head is positioned over a portion of the aperture which is smaller than the screw head;

placing the ends of the bracket in a front end of a display shelf; and tightening the screw until the indicator mounting member and the display shelf mounting member are secured to the display shelf.

10. The method of claim 9 further comprising the step of:

exchanging the bracket of the display shelf mounting member for a bracket having a different shape to provide a different mounting angle.

* * * * *

UNITED STATES PATENT AND TRADEMARK OFFICE

CERTIFICATE OF CORRECTION

PATENT NO. : 5,791,080

DATED : Aug. 11, 1998

INVENTOR(S) : Tsutomu Hamano

It is certified that error appears in the above-indentified patent and that said Letters Patent is hereby corrected as shown below:

Column 10, line 19, "after claims" insert --6--.

Signed and Sealed this

Twenty-second Day of December, 1998

Bruce Lehman

*Attest:*

BRUCE LEHMAN

*Attesting Officer*

*Commissioner of Patents and Trademarks*